US006470838B2

(12) United States Patent
Ap et al.

(10) Patent No.: US 6,470,838 B2
(45) Date of Patent: Oct. 29, 2002

(54) DEVICE FOR REGULATING THE COOLING OF A MOTOR-VEHICLE INTERNAL-COMBUSTION ENGINE IN A HOT-STARTING STATE

(75) Inventors: Ngy Srun Ap, Saint Remy les Chevreuse (FR); Mathieu Chanfreau, Paris (FR); Arnaud Maire, Montigny le Bretonneux (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/742,016

(22) Filed: Dec. 22, 2000

(65) Prior Publication Data

US 2001/0017110 A1 Aug. 30, 2001

(30) Foreign Application Priority Data

Dec. 30, 1999 (FR) ..... 99 16769

(51) Int. Cl.[7] ..... F01P 7/00
(52) U.S. Cl. ..... 123/41.12; 123/41.44
(58) Field of Search ..... 123/41.12, 41.05, 123/41.44

(56) References Cited

U.S. PATENT DOCUMENTS 5,018,484 A * 5/1991 Naitoh ..... 123/41.12
5,165,371 A * 11/1992 Hosseini ..... 123/41.12
5,529,028 A * 6/1996 Weikert ..... 123/41.12
5,619,957 A 4/1997 Michels
6,016,774 A * 1/2000 Bokkers et al. ..... 123/41.12
6,109,219 A * 8/2000 Sano ..... 123/41.12
6,178,928 B1 * 1/2001 Corrineau ..... 123/41.12
6,213,061 B1 * 4/2001 Bartolazzi et al. ..... 123/41.12
6,227,183 B1 * 5/2001 Till ..... 123/41.12

FOREIGN PATENT DOCUMENTS

EP 0442489 8/1991
EP 0965737 12/1999

* cited by examiner

*Primary Examiner*—Paul J. Hirsch
(74) *Attorney, Agent, or Firm*—Liniak, Berenato, Longacre & White

(57) ABSTRACT

A cooling circuit for a vehicle engine, traveled by fluid under pump action, comprises a cooling branch with a radiator associated with a motor-driven fan unit, and a heating branch containing an air heater. A first device establishes a hot-starting state of the engine as a function of chosen conditions; and a second device, active in this hot-starting state, controls the speed of the pump and the speed of the motor-driven fan unit under chosen conditions, as a function of a first magnitude representative of the temperature of the fluid and of a second magnitude representative of the heating demand.

11 Claims, 2 Drawing Sheets

DEVICE FOR REGULATING THE COOLING OF A MOTOR-VEHICLE INTERNAL-COMBUSTION ENGINE IN A HOT-STARTING STATE

FIELD OF THE INVENTION

The invention relates to a device for regulating the cooling of a motor-vehicle internal-combustion engine.

BACKGROUND OF THE INVENTION

In present-day internal-combustion-engined motor vehicles, the cooling device comprises a cooling circuit traveled by a fluid, which is generally water with antifreeze added. This circuit comprises a cooling branch containing a cooling radiator associated with a motor-driven fan unit, as well as a heating branch containing an air heater. The cooling radiator is swept by a flow of outside air which is put into motion by the speed of the vehicle and/or by the motor-driven fan unit. The cooling branch may also include a controlled valve.

The heating branch contains an air heater, that is to say a heating radiator which is traversed by an airflow put into motion by a blower. This airflow is then sent into the passenger compartment and distributed via appropriate distribution vents. The air heater forms part of a heating and/or air-conditioning installation with adjustable air-heating parameters.

The fluid pump (also called water pump) is usually driven mechanically by the engine, such that the throughput of the pump depends directly on the speed of the engine. It results therefrom that the energy taken up by the pump from the engine shaft is often very much higher than is strictly necessary. Moreover, it very often happens that the throughput of fluid in the air heater, which up to the present has been proportional to the speed of the engine, is insufficient to provide good heat-exchange effectiveness, and thus is insufficient to provide heating for the passenger compartment, especially when the engine is running at idling speed.

The object of the invention is especially to surmount the abovementioned drawbacks.

In particular the invention envisages the regulation of the cooling of the internal-combustion engine in a start-up state with the engine hot, which may also be called re-starting state.

SUMMARY OF THE INVENTION

According to the present invention there is provided a device for regulating the cooling of a motor-vehicle internal-combustion engine, of the type comprising a cooling circuit traveled by a fluid under the action of a pump, this circuit comprising a cooling branch containing a cooling radiator associated with a motor-driven fan unit, as well as a heating branch containing an air heater, wherein the pump and the motor-driven fan unit are each actuated by a variable-speed electric motor, and which comprises:

- first means for establishing a hot-starting state of the engine as a function of chosen conditions; and
- second means, active in this hot-starting state, for controlling the speed of the pump and the speed of the motor-driven fan unit under chosen conditions, taking account of at least one predetermined law, as a function of a first magnitude representative of the temperature of the fluid and of a second magnitude representative of the heating demand.

Thus, the device of the invention first of all determines whether the engine is in a hot-starting state and, if so, it controls the speed of the pump and the speed of the motor-driven fan unit under chosen conditions, that is to say as a function of at least one predetermined law.

In particular, the device calculates the speed of the pump (and thus its throughput) and the speed of the motor-driven fan unit, so as to ensure optimum regulation over the duration of this hot-starting state.

The means for establishing the hot-starting state of the engine advantageously comprise means for detecting that the engine is running, at zero speed of the vehicle, and means for measuring or estimating a temperature representative of the thermal state of the engine and for comparing it with at least one given threshold.

This temperature representative of the thermal state of the engine is advantageously the temperature of the fluid leaving the engine.

In one preferred embodiment of the invention, the second means are able to:

- either drive the motor-driven fan unit at a minimum speed if the temperature of the fluid is above a first threshold;
- otherwise, stop the motor-driven fan unit if the temperature of the fluid is below this first threshold and above a second threshold.

In this preferred embodiment, the second means are moreover able to:

- either drive the pump at a minimum speed if the heating demand is zero;
- otherwise, drive the pump as a function of a saturation speed, if the heating demand is positive.

The invention advantageously provides for the cooling branch moreover to comprise a controlled valve. In this case, it is advantageous for the second means to be able, moreover, to regulate this controlled valve as a function of the temperature of the fluid.

More particularly, provision is advantageously made for these second means to be able to:

- either set the controlled valve to an intermediate position supplying a given temperature difference of the fluid between the inlet and outlet of the engine, when the temperature of the fluid is above a first threshold;
- otherwise, close the controlled valve if the temperature of the fluid is below this first threshold and above a second threshold.

Advantageously, the intermediate position of the controlled valve corresponds to a maximum temperature difference, which may be of about 10° C.

The first temperature threshold and the second threshold which are defined above may, by way of example, be about 110° C. and about 50° C. respectively.

BRIEF DESCRIPTION OF THE DRAWINGS

In the description which follows, given solely by way of example, reference is made to the attached drawings, in which.

DESCRIPTION OF THE PREFERRED EMBODIMENTS

Figure 1:
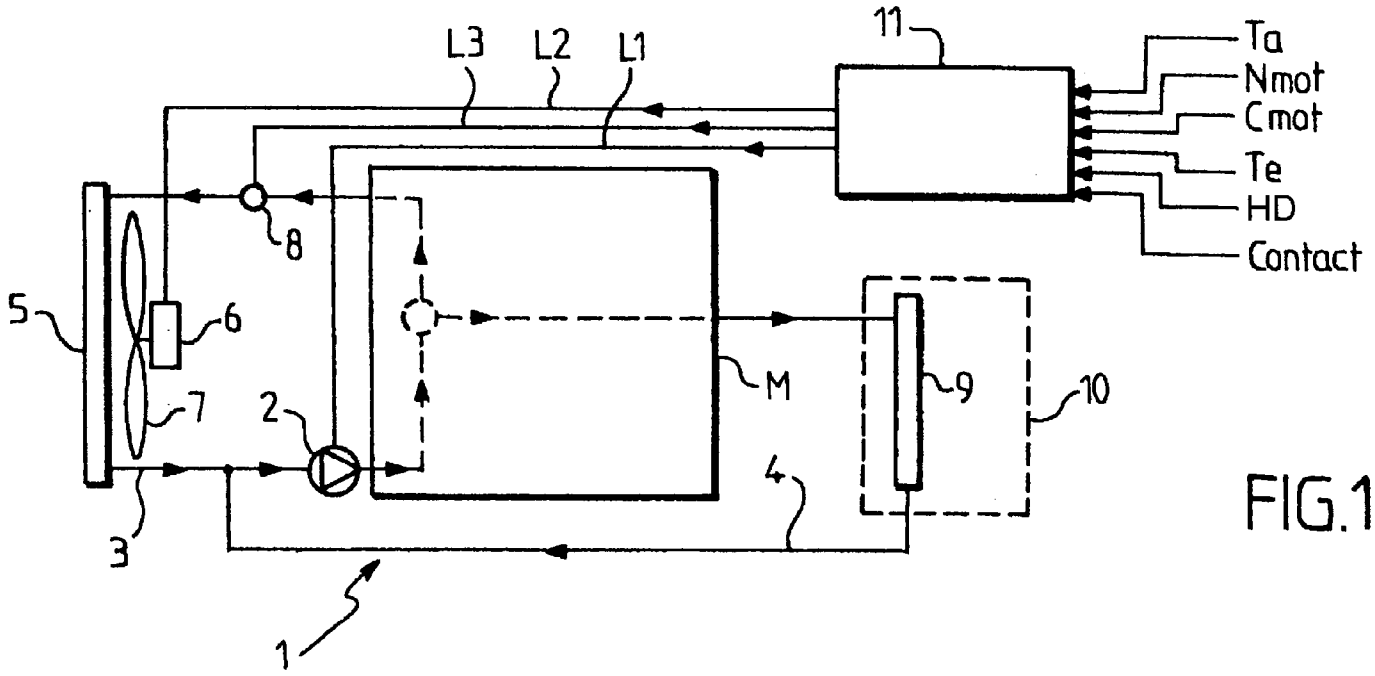
FIG. 1 is a diagram illustrating an internal-combustion engine coupled to an installation for heating a vehicle passenger compartment, as well as to a cooling device according to the invention.

In the various figures, like reference numerals refer to like parts.

Referring first of all to FIG. 1, a cooling device is shown coupled to a motor-vehicle internal-combustion engine M. This device comprises a cooling circuit 1 traveled by a cooling fluid, for example water with antifreeze, such as glycol, added. This fluid can circulate under the action of a pump 2, called "electric pump", actuated by a variable-speed electric motor. The circuit 1 comprises a cooling branch 3 and a heating branch 4 in both of which the fluid circulates under the action of the electric pump 2.

The cooling branch 3 contains a cooling radiator 5 associated with a motor-driven fan unit 6, which comprises fan blades 7 driven in rotation by a variable-speed electric motor. The branch 3 further contains, upstream of the radiator 5, a controlled valve 8 also called "controlled thermostat", especially a valve controlled either by a stepper-type electric motor or by a heating element.

The heating branch 4 contains an air heater 9, also called "heating radiator", forming part of an installation 10 for heating and/or air conditioning of the passenger compartment of the vehicle.

The radiator 5 can be traversed by an airflow the speed of which depends on the speed of the vehicle and on that of the motor-driven fan unit. The air heater 9 can be traversed by an airflow put into motion by a blower (not represented) and able then to be distributed into the passenger compartment through appropriate vents.

The device of the invention comprises a control module 11, also called computer, which can be implemented, for example, in the form of a microprocessor, or of an ASIC. This computer is linked by control lines L1, L2 and L3 respectively to the electric pump 2, to the motor-driven fan unit 6 and to the controlled valve. This computer, as a function of parameters which will be specified, determines the speed Np of the pump 2 (which determines its throughput), the speed Ng of the motor-driven fan unit 6 and the position Pv of the controlled valve 8. It takes account of one or more optimization laws contained in the memory means.

The device of the invention aims to regulate the cooling of the engine in a particular state, called "hot-starting state", or HSS for short, which may also be called re-starting state. In this operating state, the engine is started again although it is still hot and although the speed of the vehicle is zero (vehicle stopped). In the conventional cooling devices, the pump which puts the fluid into motion in the circuit is a mechanical pump coupled to the engine, such that the speed of the pump is proportional to that of the engine. It results therefrom that, in a hot-starting state, the speed of the pump is not optimal.

Likewise, in the known devices, the motor-driven fan unit is usually actuated on the basis of thermal contacts, in direct relation with the temperature of the fluid measured in the circuit.

In the invention, the computer makes it possible to manage the cooling of the engine in this particular state as a function of specific parameters.

The device of the invention defines a strategy for controlling the pump, the motor-driven fan unit and the controlled valve which, as a function of certain input data, calculates the speed of the pump, the speed of the motor-driven fan unit and the position of the controlled valve. This strategy is in accordance with the optimization law or laws of the computer.

In what follows, the initial assumption is that the heating branch 4 does not include a regulation valve and that the management of the blower (not represented) associated with the air heater 9 is not taken into account.

In the example, the input data of the computer 11 (FIG. 1) are the measurements of the following magnitudes:

temperature of the ambient air: Ta, speed of the engine: Nmot, load on the engine: Cmot, temperature of the fluid (water) leaving the engine: Te, heating position: HD, and contact of the engine.

The temperature of the ambient air Ta is picked up outside the vehicle by an appropriate sensor.

The speed of the engine Nmot corresponds to the number of revolutions of the engine and is supplied, for example, by an injection computer.

The load on the engine Cmot is supplied, for example, by the position of the accelerator pedal, the position of a carburettor butterfly, etc.

The temperature of the fluid leaving the engine Te is supplied by an appropriate temperature sensor.

The heating position HD is defined by a value in terms of percentage of the maximum heating demand.

This position can be supplied directly by a manual setting device, or else from the set-point temperature and from the temperature of the passenger compartment in the case of an automatic heating/air-conditioning apparatus.

Consequently, this heating position may lie between 0% (no heating demand) and 100% (maximum heating demand.

The computer 11 may also receive an item of input data called "contact" for supplying a signal indicating that the internal-combustion engine is running and that the speed of the vehicle is zero (vehicle stopped).

Figure 2:
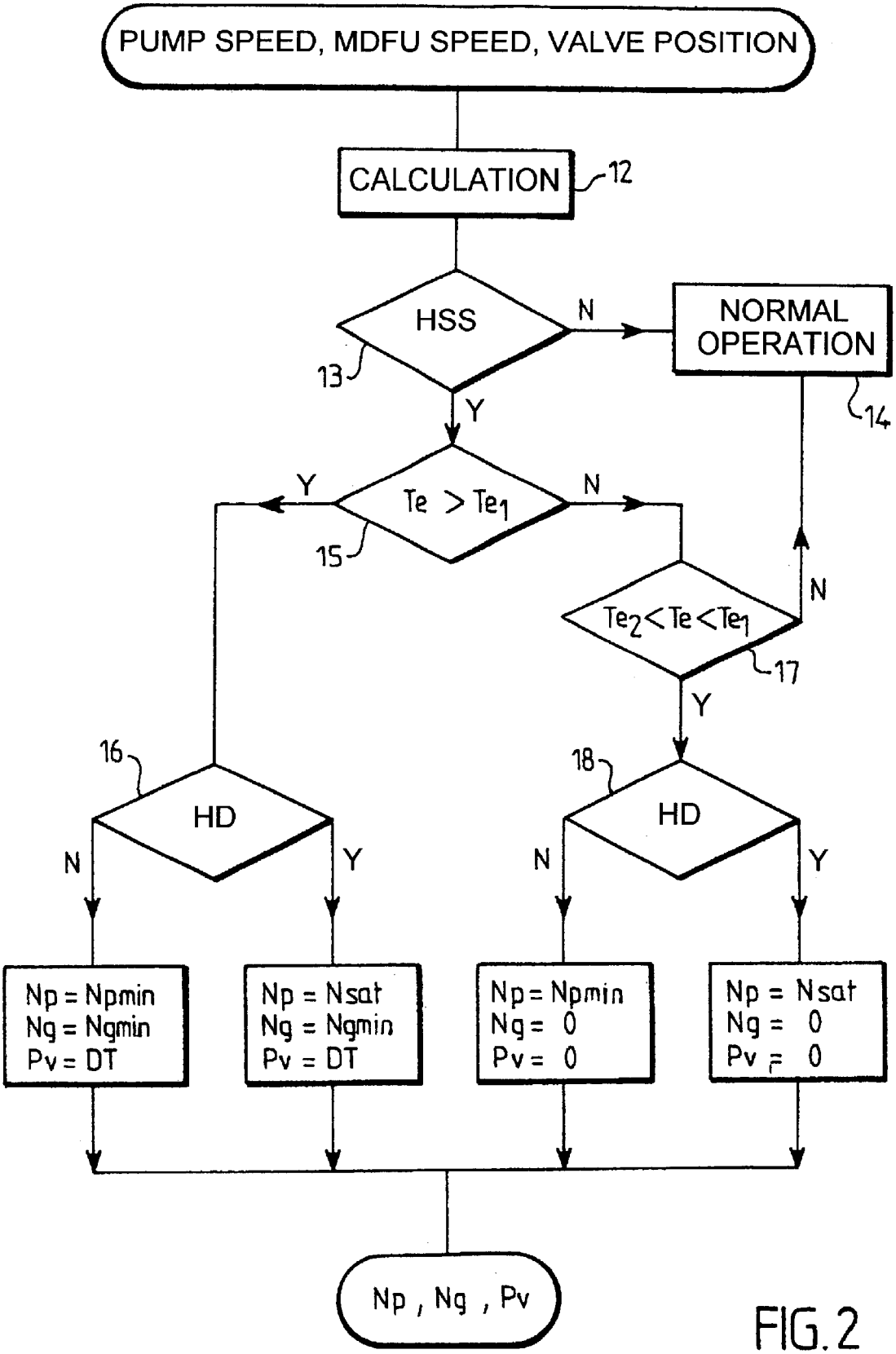
FIG. 2 is a flowchart of the operation of the device in one embodiment.

The flowchart of FIG. 2 will now be referred to in order to describe the operation of the computer 11 which controls the electric pump 2, the motor-driven fan unit 6 and the controlled valve 8.

The computer 11 comprises calculating means 12 which, via a comparator 13, determine whether the engine M is in the hot-starting state HSS. To do that, the engine has to be running, that is to say that its speed has to exceed a given threshold, for example 400 rpm, the speed of the vehicle has to be zero, and the temperature of the fluid Te has to be higher than ambient temperature, that is to say in practice higher than a pre-defined threshold.

If the comparison is negative, that is to say if the engine is not in the hot-starting state HSS, the cooling is managed by other calculating means 14 which correspond to a normal operating mode, and which do not form part of the invention.

In contrast, if the comparison is positive, a hot-starting state HSS is detected.

In this case, the computer receives a signal corresponding to the value of the temperature of the fluid Te. This takes the form of an instantaneous value which, by assumption, is higher than the ambient temperature.

In the example, this instantaneous value Te is compared first of all with a first threshold value $Te_1$ which is of the order of 110° C., for example. This first comparison is carried out by a comparator 15.

If the result of this comparison is positive, that is to say if Te is higher than Tel, then the computer takes into account the heating demand HD in a comparator 16.

At the output of the comparator 15, another comparator 17 is provided which compares the instantaneous value Te, on the one hand, with this first threshold Tel, and, on the other hand, with a second threshold $Te_2$ which is itself below $Te_1$. By way of example, this threshold $Te_2$ may be of the order of 50° C.

If the comparison is positive, that is to say if it transpires that Te lies between $Te_2$ and $Te_1$, then the computer takes the heating demand into account in another comparator 18.

The comparator 16 takes account of the heating demand. If there is no heating demand (heating position=0), then the computer establishes the following operating conditions:

it controls the motor-driven fan unit so that its speed is a minimum, such that Ng=Ngmin.

It also drives the pump such that its speed is a minimum, such that Np=Npmin.

Likewise, the computer sets the position of the controlled valve so that it delivers a temperature difference DT which reaches a maximum value (DTmax) having a given value, for example 10° C.

If the heating demand is positive, the computer then controls the device under the following conditions:

speed of the motor-driven fan unit set to the minimum, that is to say Ng=Ngmin, and speed of the pump proportional to a saturation speed, that is to say Np=Nsat.

Figure 3:
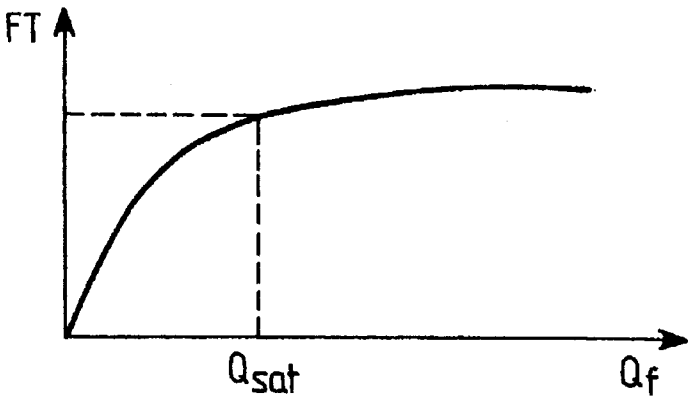
FIG. 3 is a curve illustrating the variations in the saturation throughput of the pump in the air heater of the heating installation.

Saturation speed Nsat is the name given here to the speed of the pump at which it possible to obtain a saturation throughput in the air heater. This saturation throughput corresponds to the throughput of the fluid which makes it possible to obtain 90% of an asymptotic thermal flux for a given air throughput. FIG. 3 illustrates the variations in the thermal flux FT as a function of the throughput of fluid Qf, the saturation throughput being designated by Qsat.

The position of the valve is set so that the temperature difference DT between the inlet and the outlet of the engine are less than or equal to DTmax, for example 10° C. as in the previous case.

Hence, in the two cases above, the engine will be cooled down until the temperature of the fluid falls and reaches an optimal value.

The comparator 18 also takes the heating demand into account. If there is no heating demand, the computer controls the device under the following conditions:

speed of the pump Np established at a minimum value Npmin, and speed of the motor-driven fan unit established at a zero value (fan stopped), position of the valve=0, which corresponds to closure of the controlled valve.

If there is a heating demand, the comparator 18 controls the device under the following conditions:

speed of the motor-driven fan unit zero, speed of the pump Np fixed at the saturation value Nsat, and null position of the controlled valve, that is to say closure of the controlled valve.

In the last two cases, the engine is heated up until the temperature of the fluid reaches an optimal value.

It will be understood that the flowchart above defines laws which can be incorporated into the computer by means which are in themselves known and which are within the scope of the person skilled in the art. The computer may, for example, comprise memory means with correspondence tables for fixing the values of the parameters as a function of defined magnitudes.

Thus the device of the invention makes it possible, when a hot-starting state is established, to manage the cooling under optimum conditions by acting on the speed of the pump, on the speed of the motor-driven fan unit and on the position of the controlled valve.

These parameters are calculated essentially as a function of the instantaneous temperature of the fluid in the cooling circuit and of the heating demand as formulated by the passenger or passengers of the vehicle.

Clearly, the invention is not limited to the embodiments described above by way of example and extends to other variants.

We claim:

1. A device for regulating the cooling of a motor-vehicle internal-combustion engine comprising a cooling circuit carrying a fluid driven by a pump, said circuit comprising a cooling branch containing a cooling radiator associated with a motor-driven fan unit, as well as a heating branch containing an air heater, wherein the pump and motor-driven fan unit are each actuated by a variable-speed electric motor, and which comprises:

first means for establishing a hot-starting state of the engine as a function of chosen conditions; and second means, active in said hot-starting state, for controlling the speed of the pump and the speed of the motor-driven fan unit as a function of a first magnitude representative of the temperature of the fluid and of a second magnitude representative of the heating demand, wherein said second means further controls the speed of the pump and the motor-driven fan unit based on speed of the engine and load on the engine.

2. The device of claim 1, wherein the first means for establishing the hot-starting state of the engine comprise means for detecting that the engine is running when the vehicle is stationary, and means for determining an engine temperature representative of the thermal state of the engine and for comparing it with at least one given threshold.

3. The device of claim 2, wherein the engine temperature representative of the thermal state of the engine is the temperature of the fluid leaving the engine.

4. The device of claim 1, wherein the second means is adapted to perform one of the following functions:

drive the motor-driven fan unit at a minimum speed if the temperature of the fluid is above a first threshold; and stop the motor-driven fan unit if the temperature of the fluid is below said first threshold and above a second threshold.

5. The device of claim 1, wherein the second means is adapted to perform one of the following functions:

drive the pump at a minimum speed if the heating demand is zero; and drive the pump as a function of a saturation speed, if the heating demand is positive.

6. The device of claim 1, wherein the cooling branch further comprises a controlled valve, and wherein the second means further is adapted to regulate the controlled valve as a function of the temperature of the fluid.

7. The device of claim 6, wherein the second means is adapted to perform one of the following functions:

set the controlled valve to an intermediate position supplying a given temperature difference of the fluid between the inlet and outlet of the engine, when the temperature of the fluid is above a first threshold; and close the controlled valve if the temperature of the fluid is below said first threshold and above a second threshold.

8. The device of claim 7, wherein the intermediate position of the controlled valve corresponds to a maximum temperature difference.

9. The device of claim 8, wherein the maximum temperature difference is about 10° C.

10. The device of claim 4, wherein the first threshold is about 110° C. and the second threshold about 50° C.

11. The device of claim 7, wherein the first threshold is about 110° C. and the second threshold about 50° C.

* * * * *